US007233674B2

(12) United States Patent
Song

(10) Patent No.: US 7,233,674 B2
(45) Date of Patent: Jun. 19, 2007

(54) INTEGRATED BASE AND ELECTRET CONDENSER MICROPHONE USING THE SAME

(75) Inventor: Chung Dam Song, Seoul (KR)

(73) Assignee: BSE Co., Ltd. (KR)

( * ) Notice: Subject to any disclaimer, the term of this patent is extended or adjusted under 35 U.S.C. 154(b) by 398 days.

(21) Appl. No.: 10/847,544

(22) Filed: May 18, 2004

(65) Prior Publication Data

US 2005/0025328 A1 Feb. 3, 2005

(30) Foreign Application Priority Data

Jul. 29, 2003 (KR) ..... 20-2003-0024411

(51) Int. Cl.
*H04R 19/01* (2006.01)

(52) U.S. Cl. ..... 381/174; 381/113; 381/191

(58) Field of Classification Search ..... 381/173–176, 381/355, 396, 398, 369, 191, 170, 181, 113; 29/25.41, 594

See application file for complete search history.

(56) References Cited

U.S. PATENT DOCUMENTS 5,101,543 A * 4/1992 Cote et al. ..... 29/25.41
6,512,833 B2 * 1/2003 Himori et al. ..... 381/174
6,678,383 B2 * 1/2004 Ito et al. ..... 381/174
2005/0089180 A1 * 4/2005 Saeki et al. ..... 381/174

* cited by examiner

*Primary Examiner*—Daniel Swerdlow
(74) *Attorney, Agent, or Firm*—Keusey, Tutunjian & Bitetto, P.C.

(57) ABSTRACT

An electret condenser microphone includes a case, a diaphragm electrically connected to the case, a fixed electrode plate disposed opposing the diaphragm with a spacer interposed therebetween, the fixed electrode plate being formed of a metal plate coated with a polymer film on which an electret is formed, an insulating ring for insulating the fixed electrode plate from the case, a printed circuit board (PCB) defining a back chamber with the fixed electrode plate, and an integrated base for supporting the fixed electrode plate and the PCB and electrically connecting the fixed electrode plate to the circuit component embedded in the PCB through a connecting terminal. The integrated base includes a hollow cylindrical insulating body and metal plating layers formed on the top and bottom of the insulating body. Outer diameters of the metal plating layers are less than the insulating body and are electrically connected by a conductor.

7 Claims, 6 Drawing Sheets

INTEGRATED BASE AND ELECTRET CONDENSER MICROPHONE USING THE SAME

BACKGROUND OF THE INVENTION

1. Field of the Invention

The present invention relates to an electret condenser microphone and, more particularly, to an electret condenser microphone that is improved in performance by a fixed electrode plate increased in size and a back chamber increased in volume.

2. Description of the Related Art

FIG. 1 shows a conventional electret condenser microphone. The conventional electret condenser microphone 100 includes a cylindrical metal case 11, a conductive polar ring 12*a*, a diaphragm 12*b*, a spacer 13, a fixed electrode plate 14, a ring-shaped insulting base 15, a ring-shaped conductive base 16, and a printed circuit board (PCB) 17 on which circuit components and a connection terminal is formed. The polar ring 12*a* and the diaphragm l2*b* may be integrated with each other as a single diaphragm plate 12. The fixed electrode plate 14 includes a conductive metal plate 14*b* coated with a polymer film 14*a* on which an electret is formed.

In such a conventional electret condenser microphone 100, since the insulating base 15, insulating the fixed electrode plate 14 from the case 11, is formed to be relatively thick to provide sufficient supporting force, the size of the fixed electrode plate 14 is limited. In addition, since the conductive base 16 is disposed inside the insulating base 15, a volume of a back chamber is reduced, deteriorating the performance of the microphone. That is, since the conventional electret condenser microphone 100 is designed in a dual-ring structure where the ring-shaped conductive base 16 is fitted in the ring-shaped insulating base 15, an inner diameter of the conductive base 16 is reduced to thereby reduce the volume of the back chamber. Furthermore, in some cases, the fixed electrode plate 14 may be assembled by being fitted in the insulating base 15. In this case, a size of the fixed electrode plate 14 is reduced, as a result of which a size of the diaphragm 12*b* opposing the fixed electrode plate 14 is also reduced, thereby deteriorating acoustic properties such as sound sensitivity and frequency response.

SUMMARY OF THE INVENTION

Accordingly, the present invention is directed to an electret condenser microphone that substantially obviates one or more problems due to limitations and disadvantages of the related art.

An object of the present invention is to provide an integrated base that is formed by integrating an insulating base with a conductive base, thereby enlarging a volume of a back chamber.

Another object of the present invention is to provide an electret condenser microphone that uses a separated insulating ring for insulating a fixed electrode plate to increase a size of the fixed electrode plate, thereby being improved in its performance.

To achieve these objects and other advantages and in accordance with the purpose of the invention, as embodied and broadly described herein, there is provided an integrated base for an electret condenser microphone, comprising a hollow cylindrical insulating body having a top and a bottom; and first and second metal plating layers formed on the top and bottom of the hollow cylindrical insulating body, respectively, outer diameters of the first and second metal plating layers are less than that of the insulating body, the first and second metal plating layers being conducted to each other by one of a conductive pattern formed on an inner circumference of the insulating body and a through or via hole formed through the insulating body.

In another aspect of the present invention, there is provided an electret condenser microphone comprising a case having a bottom provided with sound holes; a diaphragm electrically connected to the case and vibrated in accordance with sound pressure introduced through the sound holes; a fixed electrode plate disposed opposing the diaphragm with a spacer interposed therebetween, the fixed electrode plate being formed of a metal plate coated with a polymer film on which an electret is formed; an insulating ring for insulating the fixed electrode plate from the case; a printed circuit board in which a circuit component is embedded, the printed circuit board defining a back chamber with the fixed electrode plate; and an integrated base for supporting the fixed electrode plate and the printed circuit board and electrically connecting the fixed electrode plate to the circuit component embedded in the printed circuit board through a connecting terminal, the integrated base comprising a hollow cylindrical insulating body having a top and a bottom, and first and second metal plating layers formed on the top and bottom of the hollow cylindrical insulating body, respectively, outer diameters of the first and second metal plating layers being less than that of the insulating body, the first and second metal plating layers being conducted to each other by conducting means.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

It is to be understood that both the foregoing general description and the following detailed description of the present invention are exemplary and explanatory and are intended to provide illustrative explanations of the invention as claimed.

BRIEF DESCRIPTION OF THE DRAWINGS

The accompanying drawings, which are included to provide a further understanding of the invention and are incorporated in and include a part of this disclosure, illustrate embodiment(s) of the invention and together with the description serve to explain principles of the invention. In the drawings.

DESCRIPTION OF THE PREFERRED EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

The inventive electret condenser microphone includes an integrated base that is formed by a PCB manufacturing technology. The integrated base includes a hollow cylindrical insulating body having a bottom and top on which metal plating layers are formed, respectively. Outer diameters of the metal plating layers are less than that of the insulating body. The metal plating layers are conducted each other. According to the conducting method, the present invention provides first and second embodiments. That is, in the first embodiment, the metal plating layers are conducted to/between each other by a conductive pattern deposited on an inner circumference of the insulating body. In the second embodiment, the metal plating layers are conducted to/between each other by a through or via hole formed in the insulating body.

First Embodiment

Figure 1:
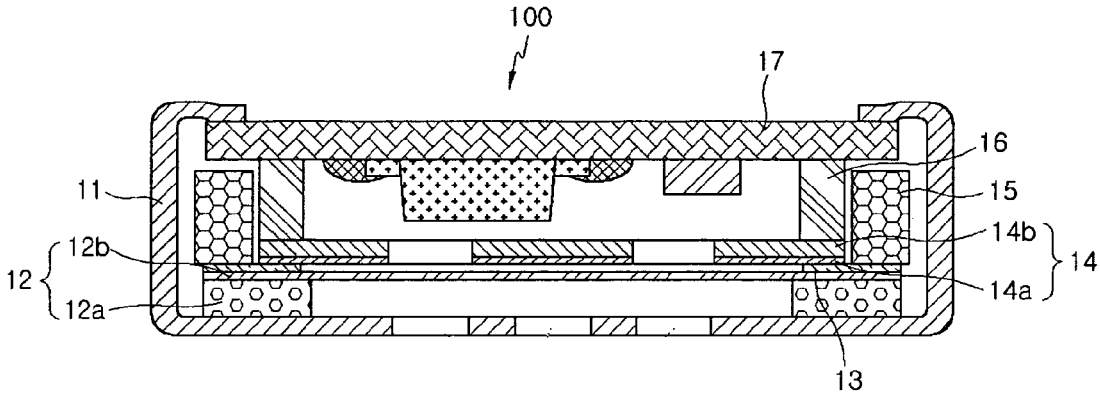
FIG. 1 (PRIOR ART)
FIG. 1 is a sectional view of a conventional electret condenser microphone.
Figure 2:
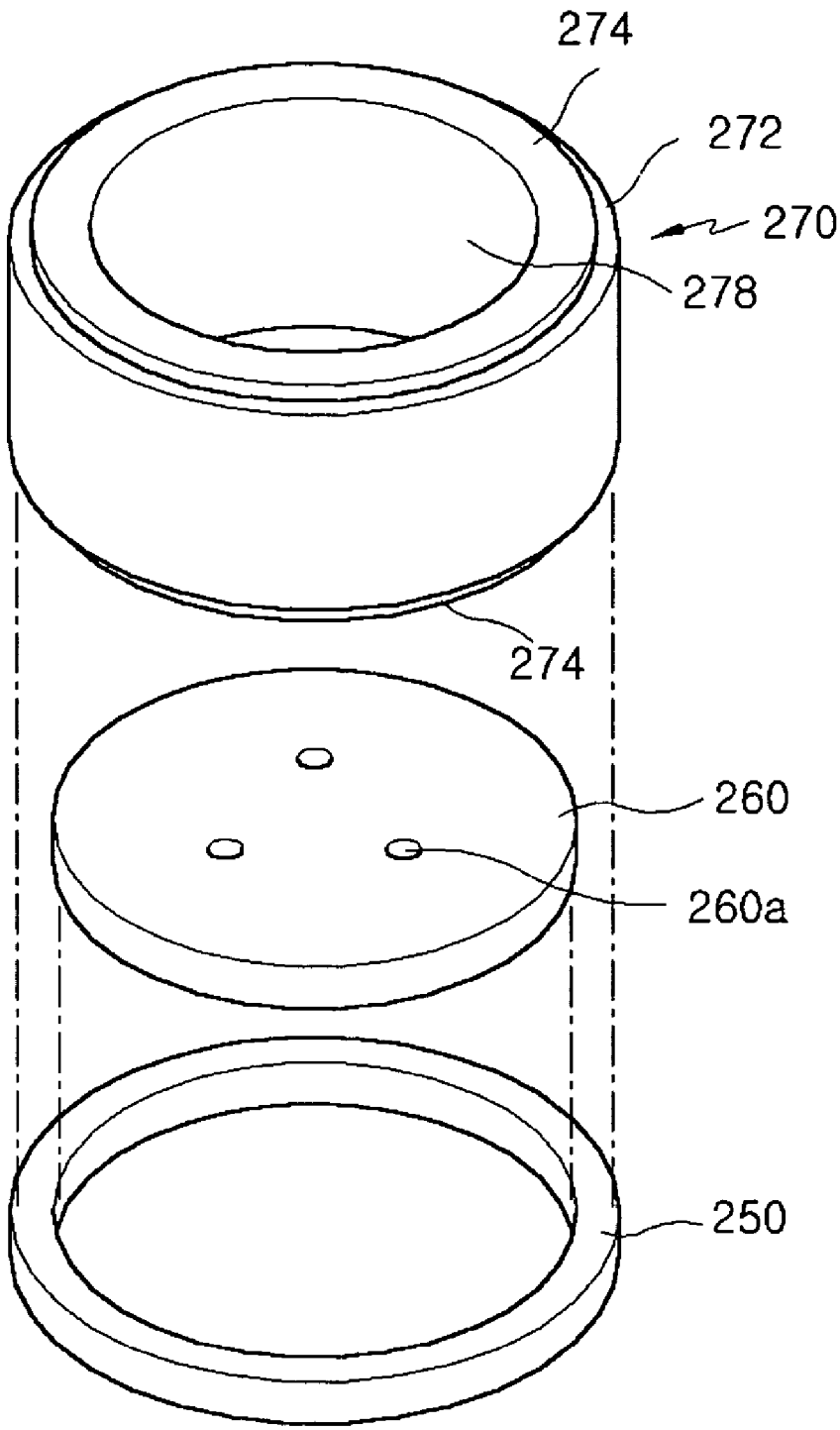
FIG. 2 is an exploded perspective view of major components of an electret condenser microphone according to a first embodiment of the present invention.

FIG. 2 shows major components of an electret condenser microphone according to a first embodiment of the present invention.

Referring to FIG. 2, there are shown a separated insulating ring 250 for insulating a fixed electrode plate 260 from a case (210 in FIG. 3) and an integrated base 270 functioning as an insulating base as well as a conductive base.

The integrated base 270 is formed by a PCB manufacturing technology rather than by molding. The integrated base 270 includes a hollow cylindrical insulating body 272 having a top and bottom that are deposited with metal plating layers 274. Formed on an inner circumference of the insulating body 272 is a conductive pattern 278 to realize an electrical conduction between the metal plating layers 274. As a result, the integrated base 270 functions as the insulating base as well as the conductive base. That is, the insulating body 272 performs an insulating function, while the metal plating layers 274 formed on the top and bottom of the insulating body 272, which contact the fixed electrode plate 260 and a PCB (280 in FIG. 3), respectively, and electrically interconnected by the conductive pattern 278, perform a conductive function.

At this point, an outer diameter of the metal plating layers 274 is less than that of the insulating body 272 such that the metal plating layers 274 do not electrically contact the case 210. Here, the insulating body 272 is an insulting PCB formed of a material, for example, a glass epoxy-based material, a resin-based material, and/or a PVC-based material.

In the above-described microphone, since an inner diameter of the integrated base 270 is enlarged as compared with the conventional art, a volume of the back chamber can be increased, thereby improving acoustic properties such as sound sensitivity and frequency response.

The fixed electrode plate 260 provided with an electret is insulated from the integrated base 270 by a separated insulating ring 250. That is, since the insulating ring 250 is separately formed, the area of the fixed electrode plate 260 can be enlarged to increase intensity of the electret and a size of a diaphragm 230 (see FIG. 3) formed opposing the fixed electrode plate 260, thereby improving the performance of the microphone. That is, in the conventional art, the fixed electrode plate is fitted in the relatively thick insulating base. However, in the present invention, since the separately prepared insulting ring 250, which is thinner than the integrated base 270 insulates the fixed electrode plate 260, it is possible to enlarge the size of the fixed electrode plate 260, increasing the intensity of the electret.

Figure 3:
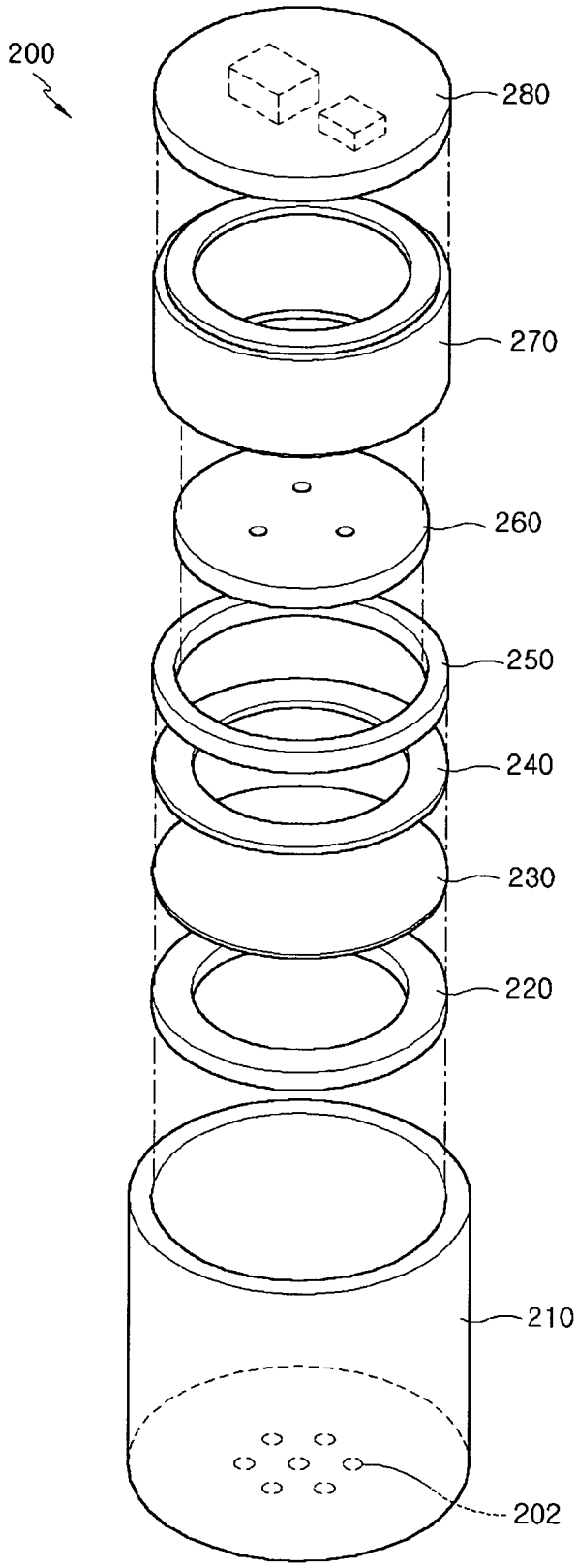
FIG. 3 is an exploded perspective view of an electret condenser microphone according to a first embodiment of the present invention.
Figure 4:
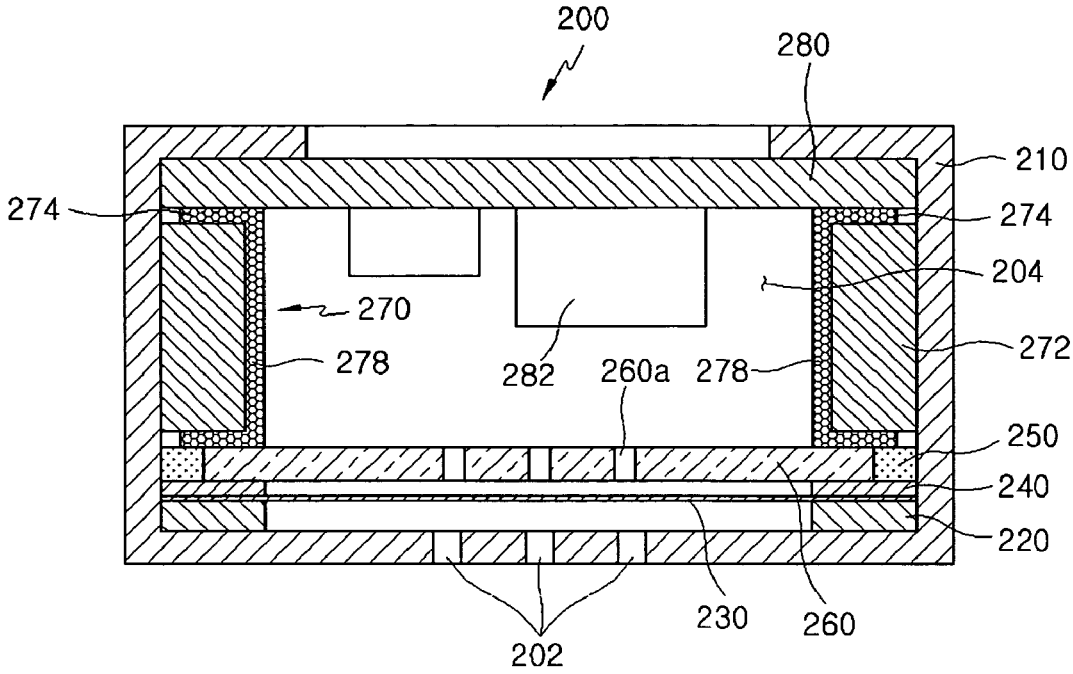
FIG. 4 is an assembled sectional view of an electret condenser microphone depicted in FIG. 3.

FIGS. 3 and 4 show an electret condenser microphone according to a first embodiment of the present invention.

Referring first to FIG. 3, the inventive microphone 200 is formed by successively inserting a polar ring 220, diaphragm 230, spacer 240, insulating ring 250, fixed electrode plate 260, integrated base 270, and PCB 280 into the cylindrical case 210 and by curling an opened end of the cylindrical case 210.

As shown in FIG. 4, the cylindrical case 210 has a closed end (a bottom end) as well as the opened end. The polar ring 220 is disposed on the bottom end of the case 210 and the diaphragm 230 is disposed on the polar ring 220. The fixed electrode plate 260 is disposed on the diaphragm 230 with the spacer 240 interposed therebetween. The bottom end of the case 210 is provided with a plurality of sound holes 202. The diaphragm 230 is electrically connected to the case 210 through the polar ring 220 that is formed of a conductive material. The diaphragm 230 and the polar ring 220 may be integrally formed as a single body.

The fixed electrode plate 260 is formed of a metal plate coated with an organic (polymer) film on which the electret is formed. The fixed electrode plate 260 is insulated from the case 210 by the insulating ring 250 rather than by the integrated base 270. At this point, since an inner diameter of the insulating ring 250 is greater than that of the integrated base 270, it is possible to design the fixed electrode plate 260 such that an outer diameter of the fixed electrode plate 260 is greater than the inner diameter of the integrated base 270.

Furthermore, the fixed electrode plate 260 is supported by the integrated base 270 and is electrically connected to the PCB 280 by the metal plating layers 274 and the conductive pattern 278 that are formed on the fixed electrode plate 270. A circuit component 282 such as JFET is embedded in the PCB and the opened end of the case 210 is curled to depress the PCB inward. The back chamber 204 is formed by a space defined by the fixed electrode plate 260, the integrated base 270 and the PCB 280. Therefore, since there is no conductive base in the present invention, the volume of the back chamber can be increased as compared with that of the conventional microphone.

The diaphragm 230 is electrically connected to the PCB through the polar ring 220 and the case 210, and the fixed electrode plate 260 is electrically connected to the PCB 280 through the metal plating layers 274 and the conductive pattern 278 of the integrated base 270.

In the above-described microphone 200, when air with a sound wave is introduced into the microphone 200 through the sound holes 202, the diaphragm 230 is vibrated by sound pressure. The air with the sound wave is further introduced into the back chamber 204 defined between the PCB 280 and the fixed electrode plate 260 through holes 260*a* formed on the fixed electrode plate 260. At this point, when the diaphragm 230 is vibrated by the sound pressure introduced through the sound holes 202, the interval between the diaphragm 230 and the fixed electrode plate 260 is varied, thereby varying an electrostatic capacity generated by the diaphragm 230 and the fixed electrode plate 260. As a result, an electric voltage signal is varied according to the sound wave. The electric voltage signal is transmitted to an integrated circuit such as the JFET embedded in the PCB 280 and amplified. The amplified voltage signal is externally transmitted through a connection terminal (not shown)

Second Embodiment

Figure 5:
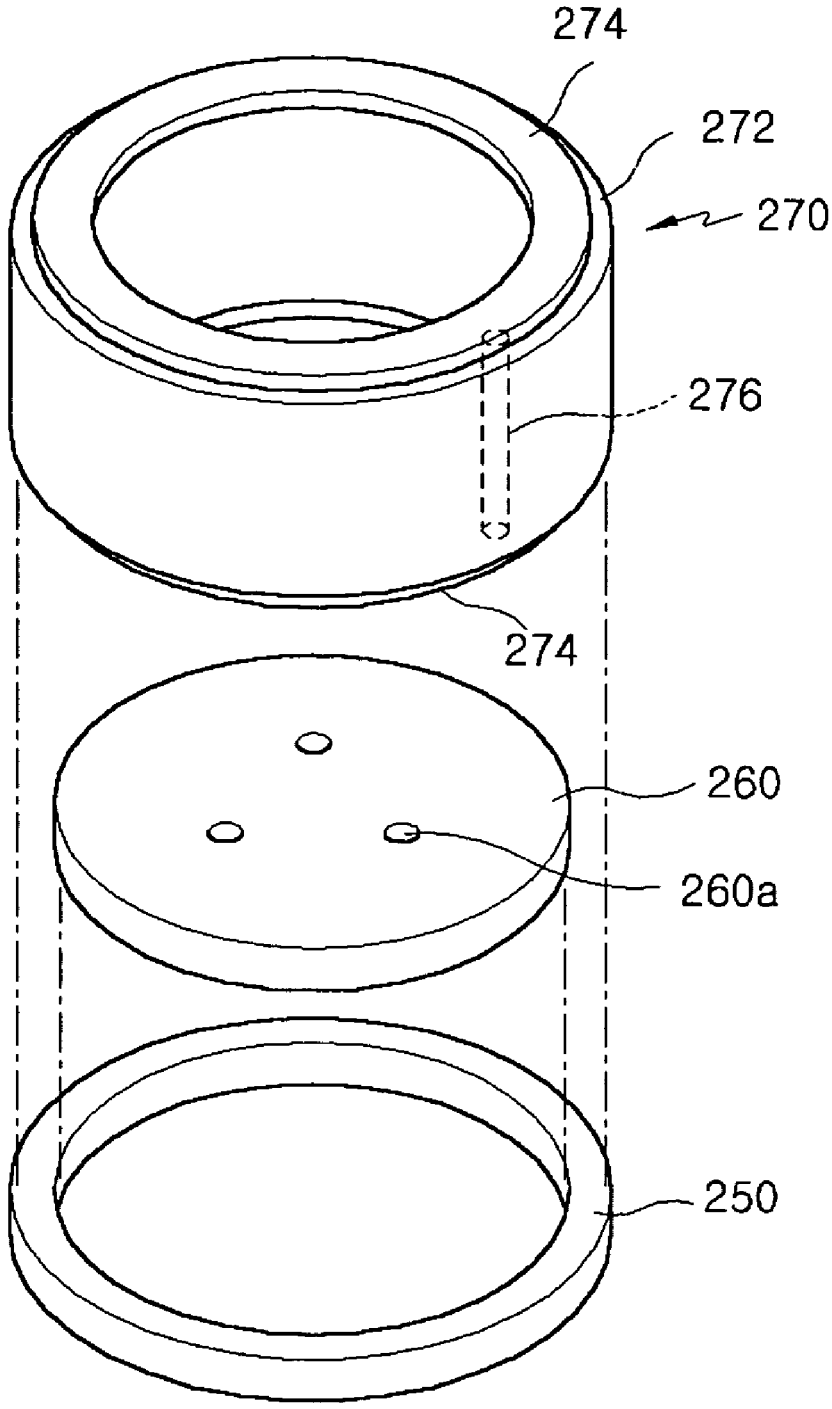
FIG. 5 is an exploded perspective view of major components of an electret condenser microphone according to a second embodiment of the present invention.
Figure 6:
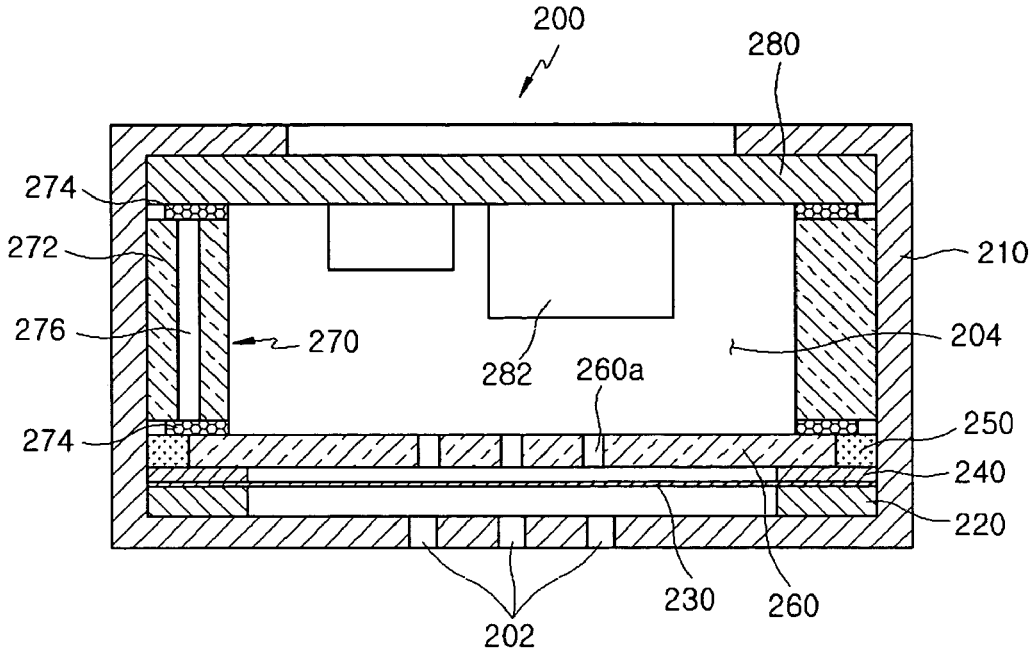
FIG. 6 is an assembled sectional view of an electret condenser microphone according to a second embodiment of the present invention.

FIGS. 5 and 6 show an electret condenser microphone according to a second embodiment of the present invention.

Referring first to FIG. 5, there is shown a separated insulating ring 250 for insulating a fixed electrode plate 260 from a case 210 and an integrated base 270 functioning as an insulating base as well as a conductive base.

The integrated base 270 is formed by a PCB manufacturing technology rather than by molding. The integrated base 270 includes a hollow cylindrical insulating body 272 having a top and bottom that are deposited with metal plating layers 274. Formed through the insulating body 272 is a through hole 276 to realize an electrical conduction between the metal plating layers 274. As a result, the integrated base 270 functions as the insulating base as well as the conductive base. That is, the insulating body 272 performs an insulating function, while the metal plating layers 274 formed on the top and bottom of the insulating body 272, which contact the fixed electrode plate 260 and a PCB 280, respectively, and electrically interconnected by the through hole 276, perform a conductive function.

At this point, an outer diameter of the metal plating layers 274 are less than that of the insulating body 272 such that the metal plating layers 274 do not electrically contact the case 210. Here, the insulating body 272 is an insulting PCB formed of a material for example, a glass epoxy-based material, a resin-based material, and/or a PVC-based material.

In the above-described microphone, since an inner diameter of the integrated base 270 is enlarged as compared with the conventional art, a volume of the back chamber can be increased, thereby improving acoustic properties such as sound sensitivity and frequency response.

As shown in FIG. 6, the cylindrical case 210 has a closed end (a bottom end) and an opened end. The polar ring 220 is disposed on the bottom end of the case 210 and the diaphragm 230 is disposed on the polar ring 220. The fixed electrode plate 260 is disposed on the diaphragm 230 with the spacer 240 interposed therebetween. The bottom end of the case 210 is provided with a plurality of sound holes 202. The diaphragm 230 is electrically connected to the case 210 through the polar ring 220 that is formed of a conductive material. The diaphragm 230 and the polar ring 220 may be integrally formed as a single body.

As described above, the second embodiment is identical to the first embodiment except that the metal plating layers 274 are conducted through the through hole (via hole) 276. Therefore, the detailed description of the operation of this embodiment will be omitted herein.

According to the present invention, conventional insulating and conductive bases are integrated as a single base. Therefore, since an inner diameter of the integrated base is enlarged as compared with the conventional art, a volume of the back chamber can be increased, thereby improving acoustic properties such as sound sensitivity and frequency response while simplifying the manufacturing process.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An integrated base for an electret condenser microphone, comprising:

an annular shaped insulating body having a top, a bottom and an inner surface; and a metal plating layers formed on the top, the bottom and the inner surface of the insulating body, and extending over the top and bottom surfaces of the insulating body such that outer diameters of the metal plating layers on the top and bottom are less than that of an outer diameter of the insulating body, the metal plating layers providing an electrical path through an inner circumference of the insulating body such that the integrated base provides a single integrated part to provide an electrical connection between the top and the bottom of the insulating body.

2. The integrated base of claim 1, wherein the insulating body is an insulating material of a printed circuit board (PCB) including at least one of a glass epoxy-based material, a resin-based material, and a PVC-based material.

3. An electret condenser microphone comprising:

a case having a bottom provided with sound holes;

a diaphragm electrically connected to the case and for being vibrated in accordance with sound pressure introduced through the sound holes;

a fixed electrode plate disposed opposing the diaphragm with a spacer interposed therebetween, the fixed electrode plate being formed of a metal plate coated with a polymer film on which an electret is formed;

an insulating ring for insulating the fixed electrode plate from the case;

a printed circuit board in which a circuit component is embedded, the printed circuit board defining a back chamber with the fixed electrode plate; and an integrated base for supporting the fixed electrode plate and the printed circuit board and electrically connecting the fixed electrode plate to the circuit component embedded in the printed circuit board through a connecting terminal, the integrated base comprising an annual shaped insulating body having a top and a bottom, and a metal plating layers integrally formed on the insulating body; and extending over the top and bottom surfaces of the insulating body such that outer diameters of the metal plating layers on the top and bottom are less than that of the insulating body, the metal plating layers forming conducting means such that the integrated base provides a single integrated part to provide an electrical connection between the top and the bottom of the insulating body.

4. The electret condenser microphone of claim 3, wherein the insulating ring has an inner diameter greater than that of the integrated base to allow an outer diameter of the fixed electrode plate to be greater than the inner diameter of the integrated base.

5. The electret condenser microphone of claim 3, wherein the conducting means includes a conductive pattern formed on an inner circumference of the insulating body.

6. The electret condenser microphone of claim 3, wherein the conducting means includes a conductor formed through a wall of the insulating body.

7. An integrated base for an electret condenser microphone, comprising:

an annular shaped insulating body having a top, a bottom and a wall; and first and second metal plating layers formed on the top and the bottom of the insulating body, respectively; such that outer diameters of the first and second metal plating layers on the top and bottom are less than that of an outer diameter of the insulating body;

a conductor disposed in a through hole in the wall of the insulating body, the conductor electrically connecting the first and second metal plating layers such that the integrated base provides a single integrated part to provide an electrical connection between the top and the bottom of the insulating body.

* * * * *